US005924657A

United States Patent [19]

Bach

[11] Patent Number: 5,924,657

[45] Date of Patent: Jul. 20, 1999

[54] BAG HOLDER

[76] Inventor: Daryl G. Bach, 3820 Pillsbury Ave. South, Minneapolis, Minn. 55409

[21] Appl. No.: 08/846,112

[22] Filed: Apr. 25, 1997

Related U.S. Application Data

[63] Continuation-in-part of application No. 08/503,201, Jul. 17, 1995, abandoned.

[51] Int. Cl.[6] ..... B65B 67/12

[52] U.S. Cl. ..... 248/97; 248/95

[58] Field of Search ..... 248/97, 95, 99, 248/100, 101, 907, 153, 146, 154, 302, 303, 505, 506

[56] References Cited

U.S. PATENT DOCUMENTS

| | | | |
|---|---|---|---|
| 711,410 | 10/1902 | Means | 220/9.1 |
| 725,538 | 4/1903 | Brown | 248/101 |
| 967,368 | 8/1910 | Grigsby | 248/153 |
| 1,124,091 | 1/1915 | Willoughby | 248/99 |
| 1,162,575 | 11/1915 | Craig | 248/153 |
| 1,278,385 | 9/1918 | Rickard | 248/94 |
| 2,113,153 | 4/1938 | Jonassen | 248/101 |
| 2,304,810 | 12/1942 | Fetterman | 248/153 |
| 2,399,498 | 4/1946 | Messick | 248/154 |
| 2,401,969 | 6/1946 | Schlank | 223/95 |
| 2,488,782 | 11/1949 | Schultheiss | 248/101 |
| 2,513,461 | 7/1950 | Duncan, Jr. | 248/154 |
| 2,673,053 | 3/1954 | Kilian | 248/153 |
| 2,706,517 | 4/1955 | Dexter et al. | 297/188.2 |
| 2,809,760 | 10/1957 | Clark | 215/11.6 |
| 3,211,404 | 10/1965 | Edmiston et al. | 248/154 |
| 3,276,733 | 10/1966 | Rosser | 248/146 |
| 3,627,242 | 12/1971 | Vandermast | 248/97 |
| 3,934,803 | 1/1976 | Paulus, Jr. | 294/1.1 |
| 3,958,785 | 5/1976 | Aboud | 294/1.1 |
| 3,995,744 | 12/1976 | Metcalf | 211/131 |
| 4,287,701 | 9/1981 | Washington | 53/390 |
| 4,440,430 | 4/1984 | Kruse | 294/1.1 |
| 4,537,376 | 8/1985 | Buku | 248/97 |
| 4,575,895 | 3/1986 | Spellman | 15/327.1 |
| 4,773,660 | 9/1988 | Trubiano | 280/33.99 |
| 4,901,959 | 2/1990 | Stage | 248/97 |

*Primary Examiner*—Derek J. Berger
*Assistant Examiner*—Anita M. King
*Attorney, Agent, or Firm*—Nikolai, Mersereau & Dietz, P.A.

[57] ABSTRACT

The present invention provides an inexpensive, portable trash bag retaining system that secures the lip of the bag in an open position and supports the remainder of the bag extending away therefrom. The bag holding apparatus of the invention provides for rapid fitting of the bag about the holder and application of self-contained resilient retention means to hold the bag in place while filling takes place. The system is entirely self-supporting and self-contained.

17 Claims, 7 Drawing Sheets

BAG HOLDER

CROSS REFERENCE TO RELATED APPLICATION

This application in a continuation-in-part of application Ser. No. 08/503,201, filed Jul. 17, 1995, now abandoned, which is deemed incorporated herein by reference in its entirety.

BACKGROUND OF THE INVENTION

1. Field of the Invention

The invention relates generally to devices or multi-use accessories for gardening, home or business and, more particularly, it relates to a lightweight and portable self-supporting framework and system principally suitable for retaining plastic leaf bags, or the like, in an open and extendable position for the collection of leaves, grass clippings and other yard trash and refuse.

2. Related Art

Plastic trash bags, particularly those fabricated from polyethylene or similar plastic films, have become the standard disposal container of yard wastes and other refuse or debris. The difficulties encountered in attempting to retain the mouth of a trash bag in an open disposition with the bag distended while attempting to fill it with leaves, grass clippings or the like are familiar to everyone. A variety of concepts have been advanced which attempt to address all or part of the problems related to supporting trash bags for filling. The patent literature describes a variety of these devices. For example, a hoop for retaining the mouth of a trash bag in a fully open position is disclosed by Washington in U.S. Pat. No. 4,287,701, in which a pair of axially spaced hoops connected by a series of flat metal strips arcuately bent around the hoops is used in combination with an externally applied circumferentially applied coil spring band nested therebetween designed to overlay and retain the edge of the mouth of an open bag placed over the hoop structure. While this system retains the mouth of the bag in an open position, it provides no means of otherwise supporting the bag and the mouth. U.S. Pat. No. 4,901,959 to Stage involves a bag support stand formed of semicircular halves each consisting of two spaced semicircular bars secured together on a pair of legs. The system halves snap together to form a bag holder having complete rings and tabs to hold the edges of the bag but the device lacks any resilient means for retaining the lip of the bag in place.

U.S. Pat. No. 3,276,753 to Rosser discloses a conical rigid pipe frame structure in the form of a rack for supporting garbage or trash cans. The can is retained by its own weight. Side handles are captured beneath the top hoop to lock the can in the frame. U.S. Pat. No. 2,398,498 discloses a holder for flower pots or baskets outdoors in which a ground spike and top hoops are used to carry a pot or basket either within or atop the hoop. For relatively large containers, elongating coil tension springs are provided along the hoop that stretch over the lip of the container from the hoop to retain the container in place. Various other hoop-type devices are illustrated in Schultheiss, U.S. Pat. No. 2,488,782; Paulus, Jr., U.S. Pat. No. 3,934,803; Aboud, U.S. Pat. No. 3,958,785; and Brown, U.S. Pat. No. 725,538.

None of the present devices provides the combined attributes of a self-contained, light portable and self-supporting system for both supporting a bag and maintaining the mouth of the bag in an open position for filling. Such a device, particularly one which is inexpensive and easily fabricated would prove very practical.

The principal object of the present invention is to provide a simple, inexpensive, multi-legged hoop frame structure onto which the lip of a plastic trash bag can be easily secured and removed.

Another object of the invention is to provide a simple, inexpensive, multi-legged wire hoop frame structure for retaining and supporting a plastic trash bag which is entirely portable and has legs which can be readily planted in the ground at any desired location.

Still another object of the invention is to provide a simple, inexpensive, multi-legged frame structure for retaining and supporting a plastic trash bag having a self-contained resilient locking mechanism.

Yet another object of the invention is to provide a simple, inexpensive, multi-legged frame structure for retaining and supporting a plastic trash bag that uses a plurality of easily operated swivel hook members to retain the trash bag lip in an open position, such as steel wire.

Other objects and advantages of the invention will become apparent to those skilled in the art as they become familiar with the present specification, drawings and claims.

SUMMARY OF THE INVENTION

The present invention provides an inexpensive, portable trash bag retaining system in the form of a multi-legged open hoop frame structure that secures the lip of the bag in an open position and supports the remainder of the bag extending away therefrom. The bag holding apparatus of the invention provides for rapid fitting of the bag about the holder and application of self-contained resilient retention means to hold the bag in place while filling takes place. The system is entirely self-supporting and self-contained.

The preferred embodiment includes framework in which a plurality of radially spaced substantially straight members in the form of legs or support stakes are connected by a plurality of axially spaced parallel metal hoops or rings, two of which are closely spaced at one end of the metal support legs or stakes (the stakes may be parallel but are preferably slightly divergent toward the end connected by the closely spaced hoops thereby forming a cylindrical or slightly conical framework attended by the plurality of metal support stakes the free end of which are designed to be planted in the ground in the manner of a tomato or other plant support hoop structure or simply used as support legs. The pair of closely spaced top hoops or end hoops are provided with a series of radially spaced latch hooks having mounting eyes at one end and hooks at the other. The eyes are threaded over the inner hoop of the pair and hooks are designed to resiliently hook over the edge of the outer or top hoop or ring, capturing the edge of a plastic leaf bag therebetween. The hooks further resiliently pull the two hoops closer together thereby creating sufficient tension to retain the bag over the outer (top) hoop. The hooks can be applied or removed readily using one hand. The material of the structure is sufficiently resilient that the hoops, once positioned will easily retain the bag and themselves remain in one location.

The bag holder of the invention may be fabricated from any suitable material and successful models have been build utilizing heavy-gauge steel wire. For example, ⅛-inch or 3⁄16-inch (approx. 0.3–0.5 cm) mild steel wire has been successfully used to form the hoops and legs or stakes which are spot welded together to form a sturdy wire frame. Of course, the bag holders can be of any convenient size (height and diameter) and the open hoops of any shape and smaller gauge wire may be employed. Typically, the end hoops are circular in shape and approximately 18 inches (~46 cm) in diameter to accommodate the lip of a typical 30-gallon (114 liter) lawn bag. Four or five stake or leg members approximately 36 inches (~92 cm) in length have been used in successful models although the number and length may vary as desired from 3 to 6 or more. The legs should be short enough so that the bottom of the bag being filled typically rests on the ground and does not have to be supported entirely by the lip clamping structure.

The hooks utilized for the flex-lock system of the invention may be similar to standard shaped wire screen door or window hooks having a mounting eye on one end and a shaped hook on the other. The pointed end on the hook normally found in such devices should be blunted to prevent bag punctures or tears. Typically, a two-inch (5 cm) hook is utilized for an average size system. While any number can be used, six hooks spaced about 60° apart around the hoops have successfully secured bags.

In an alternative embodiment, double mounting eye hooks are provided that can be mounted on the inner hoop of the closely spaced pair of hoops with one mounting eye or loop on each side of a connecting leg so that the hooking device straddles the leg. The hooks flop down when not in use and this limits the travel of the hooking device along the inner hoop when unlatched so that the hooks remain properly spaced for re-use. A plurality of spiral wire retainers wound about the top or end hoop may also be used to retain a bag lip. These are wound on both sides of the leg members also to prevent lateral travel.

BRIEF DESCRIPTION OF THE DRAWINGS

In the drawings, wherein like numerals are utilized to designate like parts throughout the same.

DETAILED DESCRIPTION

Figure 1:
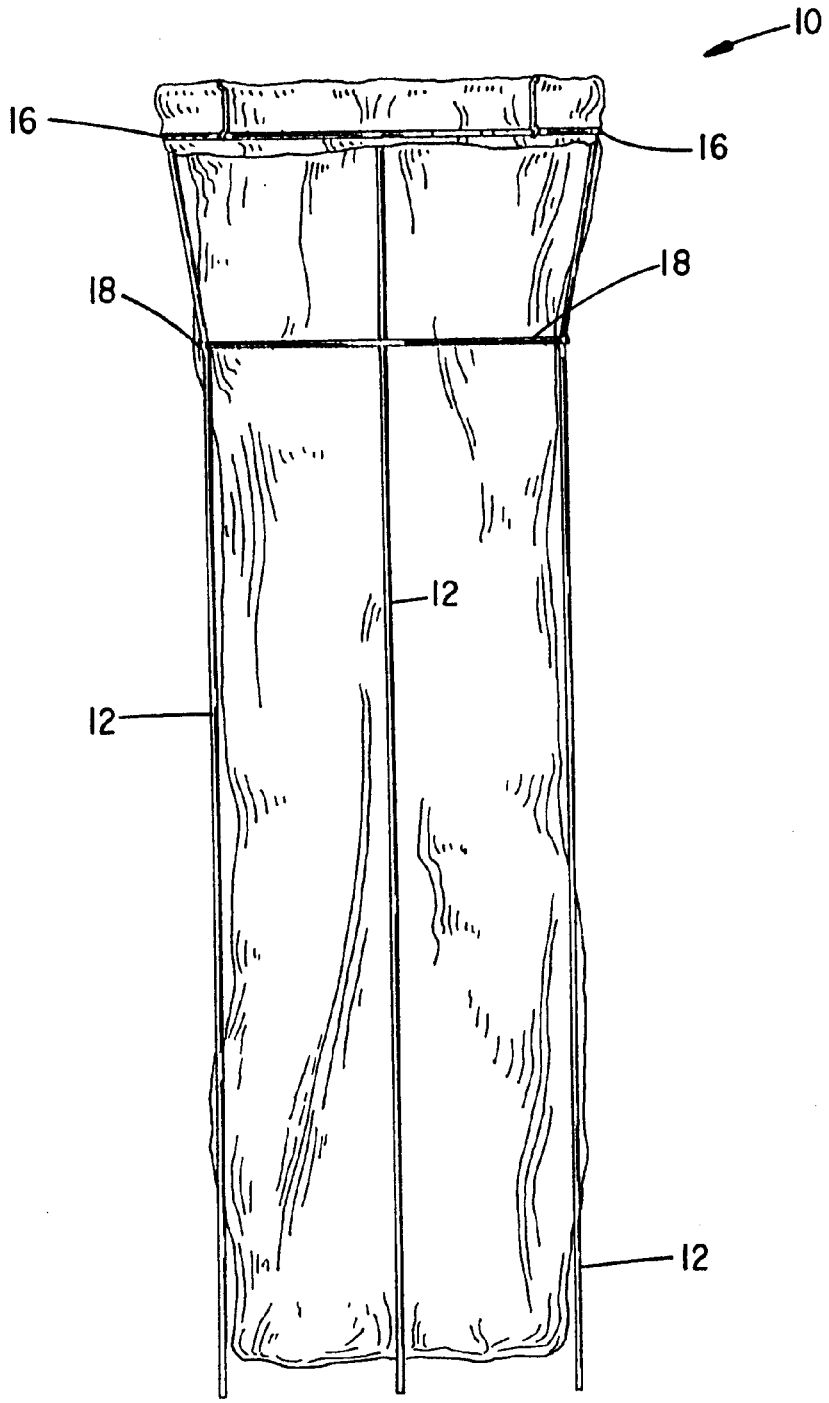
FIG. 1 is a side elevational view showing the bag hook of the invention supporting a plastic yard bag.
Figure 2:
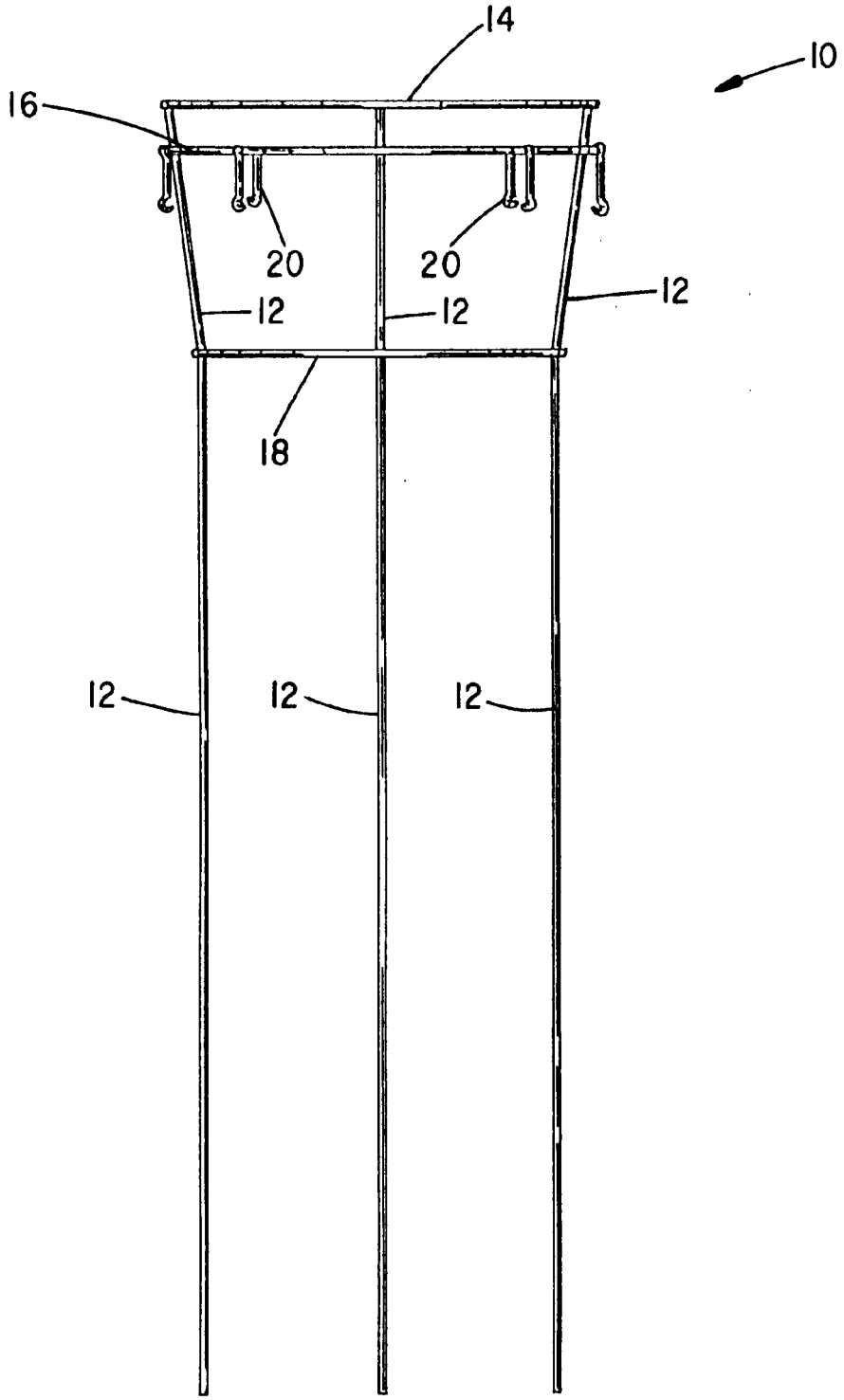
FIG. 2 is a view similar to FIG. 1 with the bag removed and the hooks unlatched.

As we refer now to the invention in greater detail, including reference to the several illustrative Figures, it will become apparent that the bag holders of the invention are lightweight, portable and stackable frameworks, easily constructed from readily available materials so as to be relatively inexpensive and reusable for many years and are preferably not welded steel wire. The bag holder is denoted generally by the reference numeral 10 in the Figures and includes a plurality of substantially parallel or slightly divergent radially spaced stake or leg members 12 connected by a plurality of axially spaced generally parallel metal hoops as at 14, 16 and 18. The hoops 14 and 16 are generally closely spaced and approximately the same size; and the hoop 18 is spaced a distance away from the hoops 14 and 16 and is generally of a slightly smaller diameter in the preferred diverging/converging models. The hoops are normally circular but may be rectangular or some other shape if desired.

Figure 3:
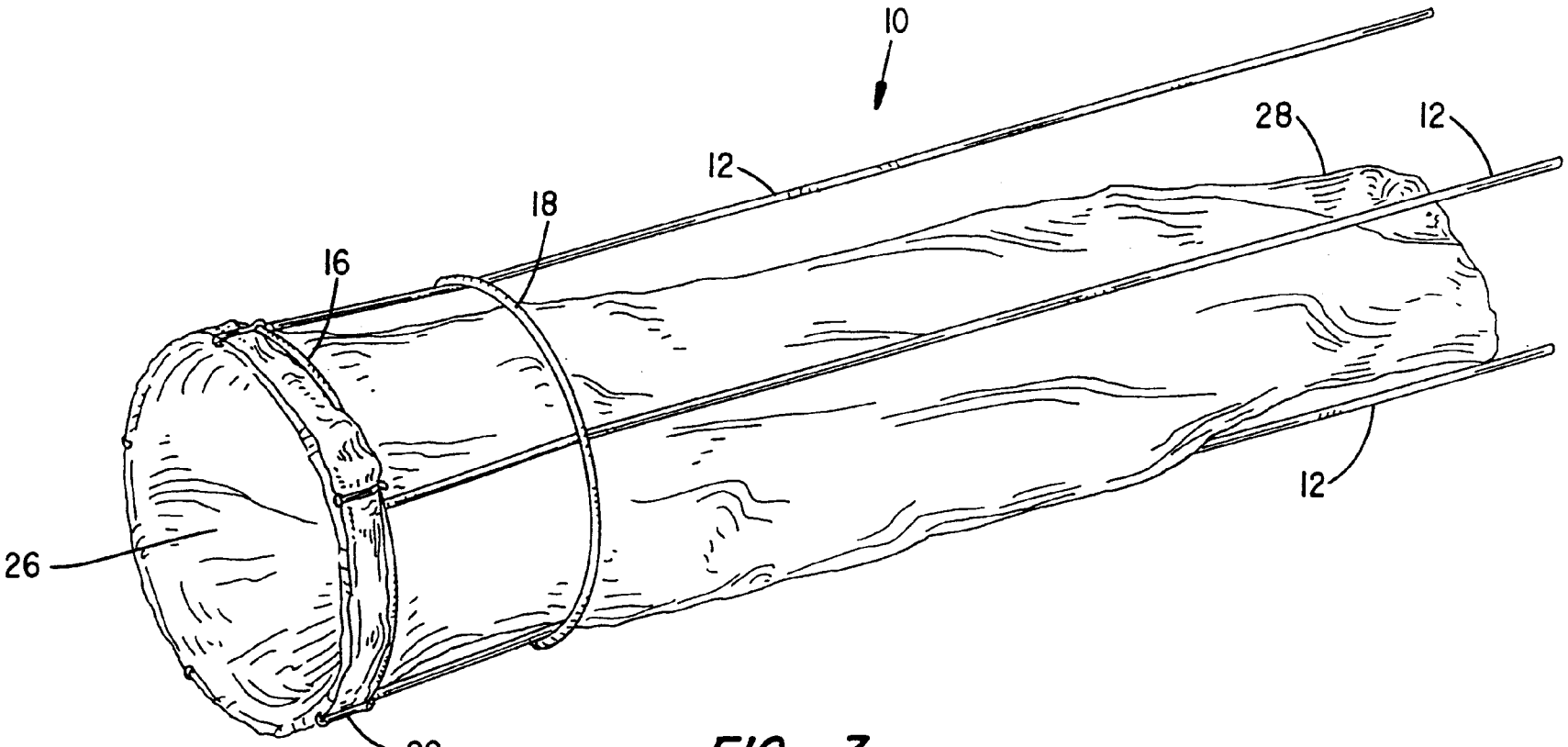
FIG. 3 is a view showing a bag retained in a substantially horizontal demeanor for receiving materials.
Figure 4:
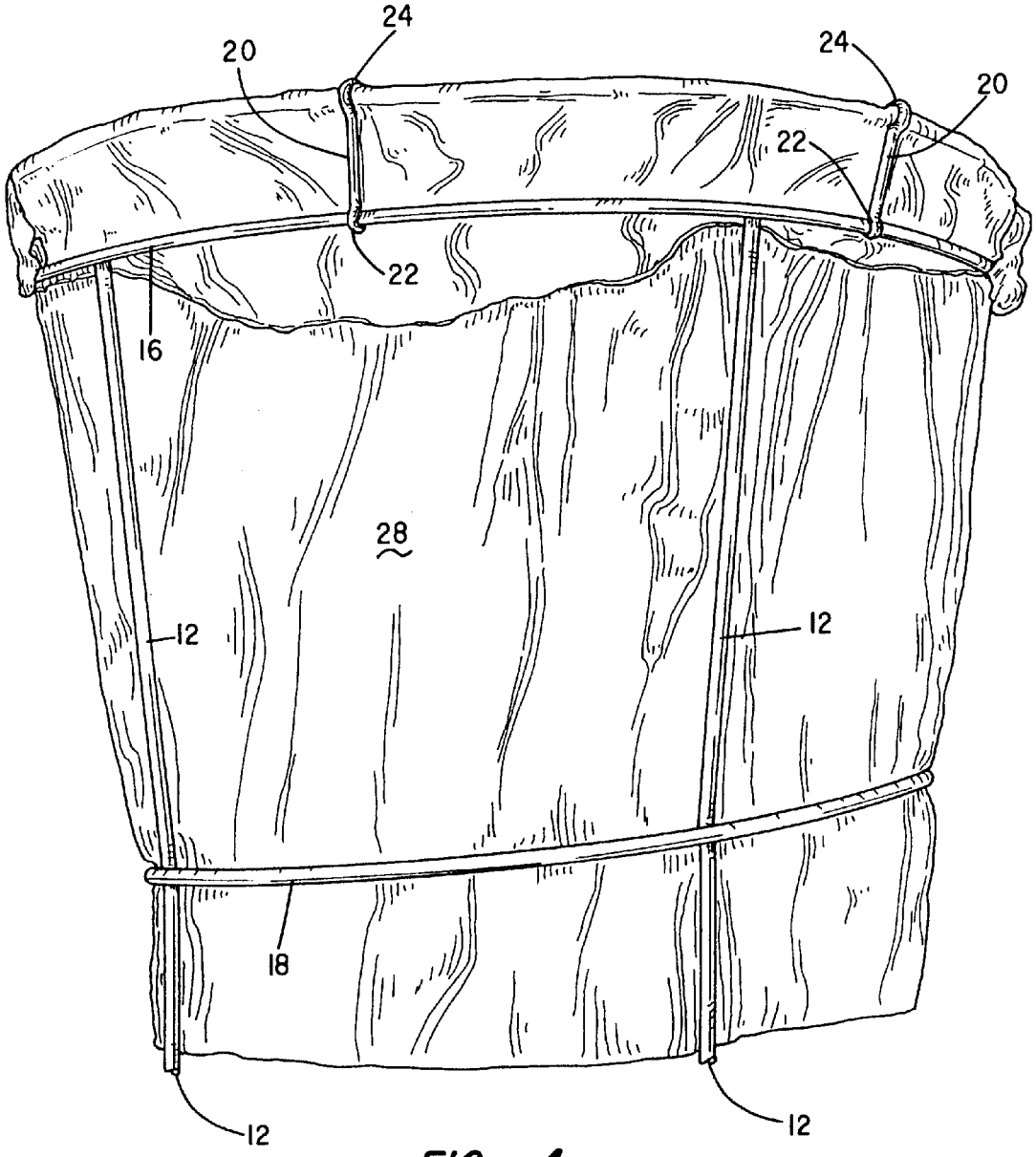
FIG. 4 is an enlarged view of a portion of FIG. 1.
Figure 5:
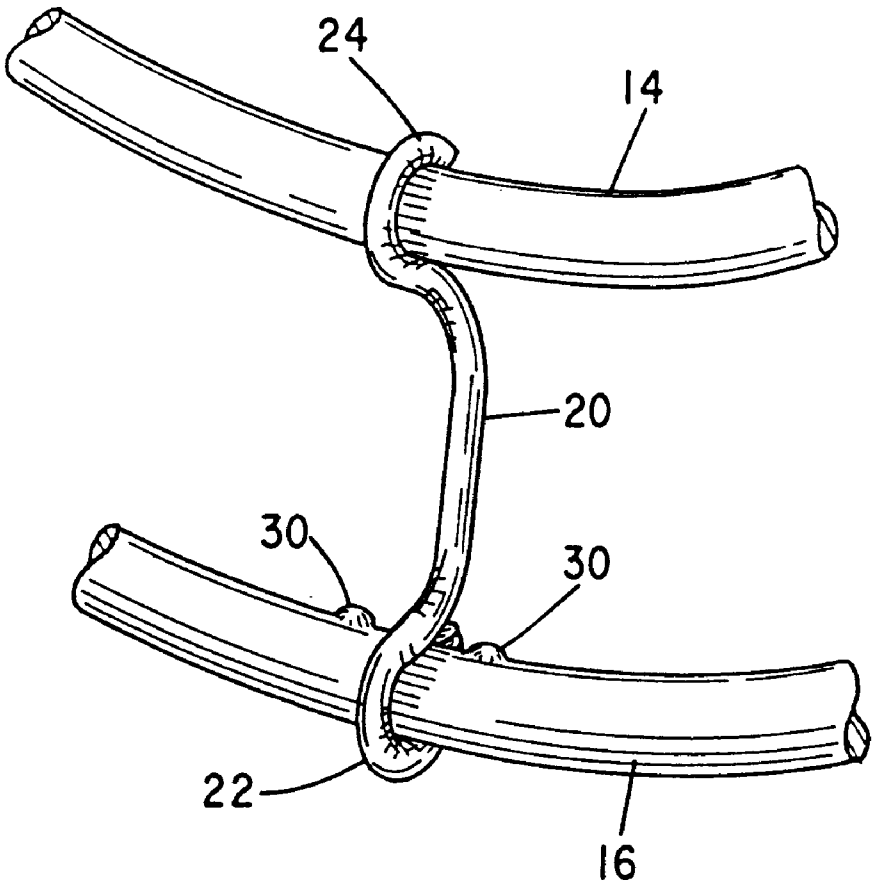
FIG. 5 is a greatly enlarged view showing a hook in place between the uppermost wire hoops.

As seen best in FIGS. 4 and 5, the hoop 16 carries a plurality of spaced rigid hook members 20, the hoop member 16 is threaded through the eye 22 of each hook member. The hook member 20 is slightly shorter than the inter-hoop distance between hoops 14 and 16 and so is designed to swivel about the hoop member 16 and attach its hook end 24 over the hoop 14 in a manner which causes the hoops 14 and 16 to be slightly resiliently distorted toward each other when the hook is in place. In this manner, as shown in FIGS. 1, 3 and 4, the lip of the mouth portion 26 of a lawn bag 28 can be folded over the top hoop 14 and retained securely in place by a plurality of the hooks 20 serially spaced about the hoop 16. If desired, retaining protrusions or bumps as at 30 or any other type of retaining means can be utilized on hoop 16 to retain the hooks 20 substantially symmetrically situated about the periphery of the hoop so that they will be in position to provide symmetrical continuous latching for a bag without having to be reestablished in position each time a bag is removed and reinstalled. Although any number can be used, good results have been obtained spacing six hooks at intervals of about 60° around the periphery of the hoop 16.

Figure 6:
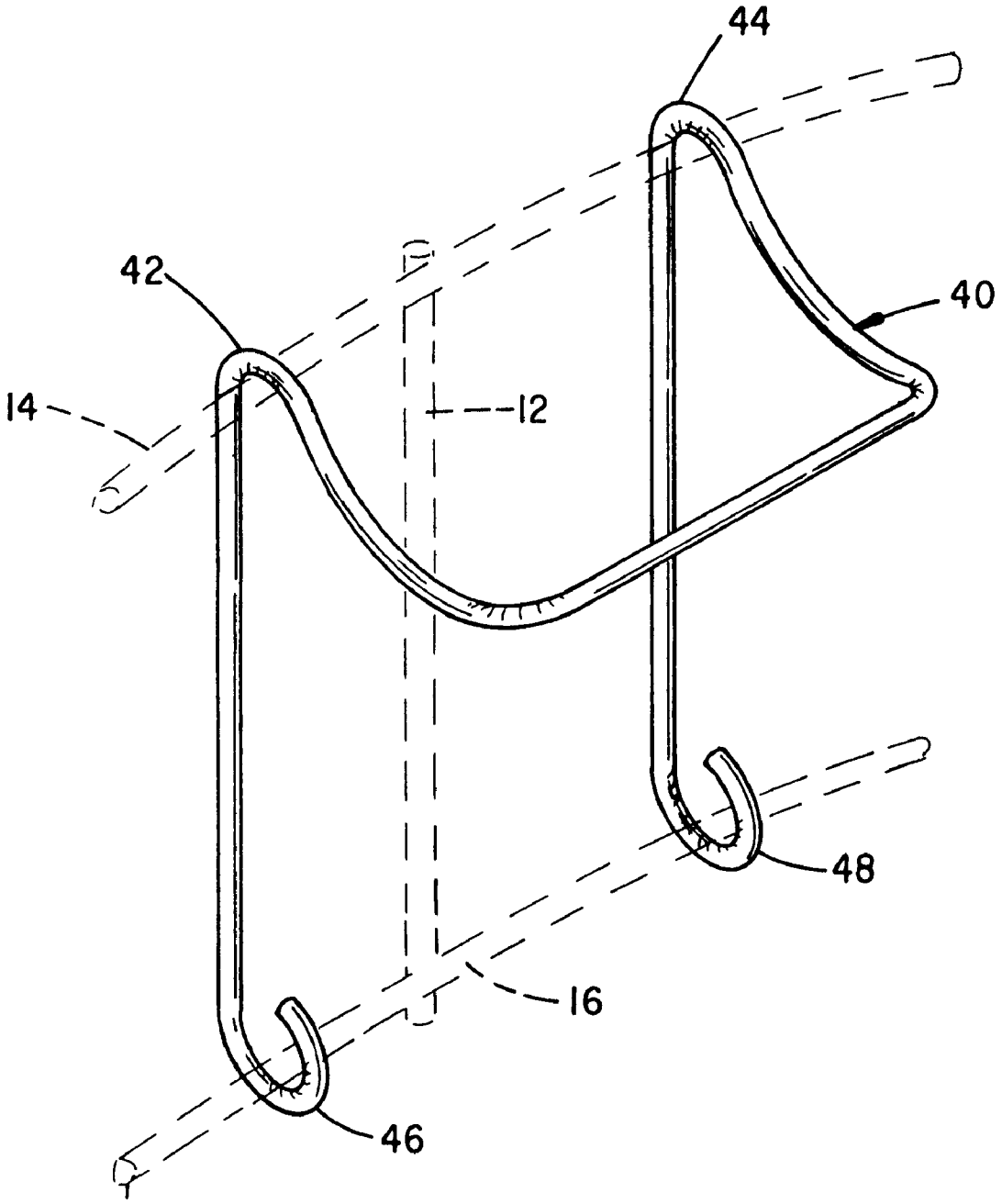
FIG. 6 depicts an alternate embodiment mounting hook in the engaging position.

FIG. 6 depicts an alternate embodiment of a hook member which utilizes double mounting eye hooks 40 fastened between the hoops 14 and 16 and straddling the longitudinal leg or stake connecting members as at 12. The hooks 40 are single piece double-mounting eye hooks that can be mounted on the inner hoop 16 to swivel outwardly and catch the upper or outer hoop members 14 snaring the edge of a bag to be held in place between the hoop member 14 and the hook member 40 as at 42 and 44. Note that the two legs of the hook members 40, 46 and 48 straddle the leg member 12 so as to limit the lateral movement of the hook member 40 when not in use and dangling from the hoop member 16. In this manner, hooks as at 40 can be spaced straddling each of the legs 12 of the frame so that they will remain substantially in place when bags are changed.

Figure 7:
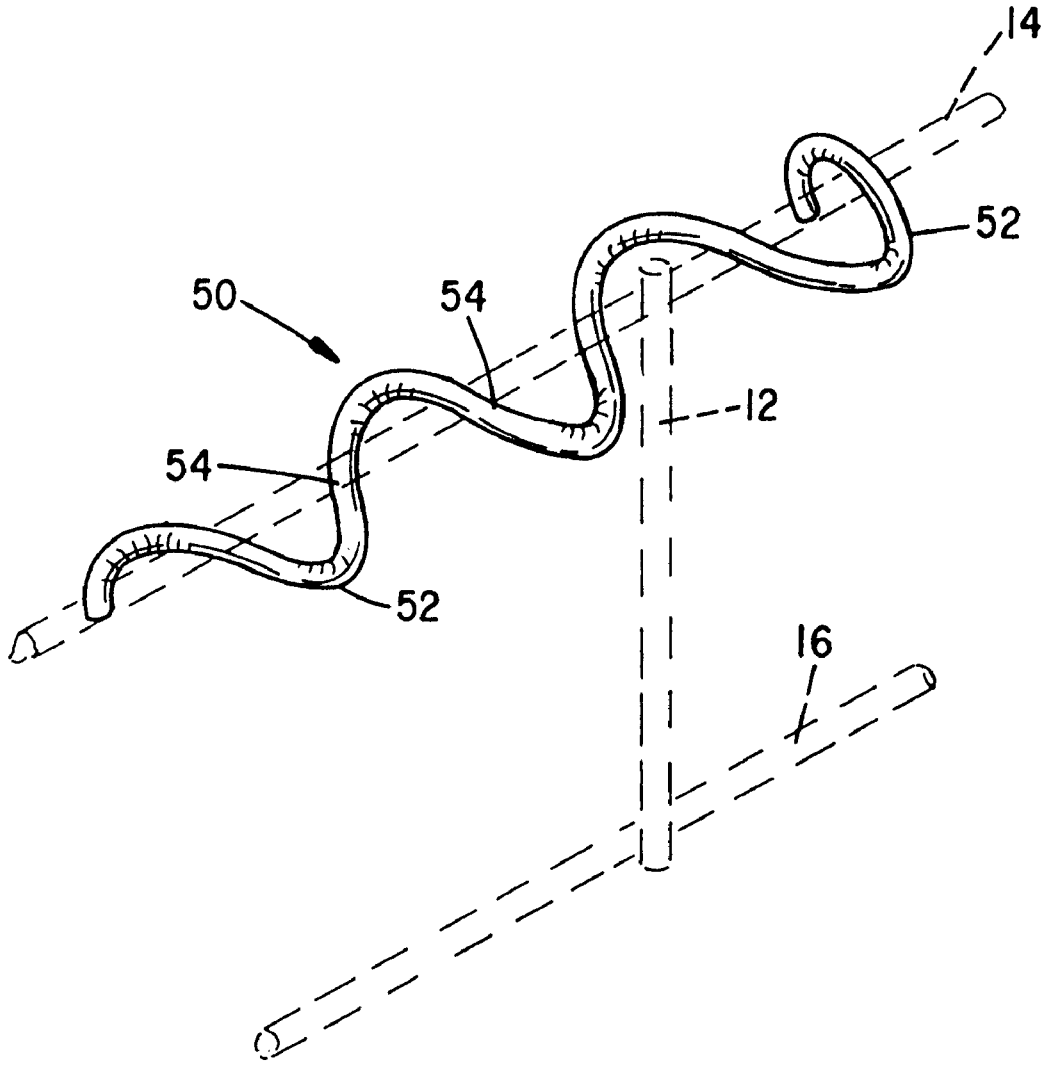
FIG. 7 depicts yet another fastening means in accordance with the invention.

FIG. 7 depicts yet another embodiment of fastener in the form of a curled wire member 50 which spirals around the hoop 14 and catches the lip of a bag beneath the hoops 52 as at 54 when the wire spiral is rotated. This spiral wire is applied so as to extend both ways from leg or stake member 12. One such fastener 50 is normally associated with each leg 12.

The resilient pressure applied over the bag lip by the series of spaced hooks 20 is sufficient to retain the bag securely in position about the member or hoop 14. It will further be noted that in the upright position as depicted in FIG. 1, the stake members are designed to be pushed into the ground in a manner such that a bag placed therein and secured to the hoop 14 will extend to the ground so that it may be filled without creating additional stress on the secured open mouth. Of course, once it is filled, the bag can be readily removed by popping off the hooks and removing the frame leaving the folded bag open end up and in position to be tied or removed. It will be further recognized that each of the hooks can be manipulated on or off with but one hand further facilitating the use of the device.

In FIG. 3, the bag holding frame of the invention is seen in a prone or horizontal position where leaves or other material can be raked in directly or other material put or swept into the bag without the need for lifting it as in the upright position.

As indicated above, the framework of the bag holder of the invention is typically made of relatively stiff heavy-gauge steel wire material, preferably about 3/16-in (0.5 cm) in diameter (gauge) and the upper hoops 14 and 16 are typically about 18 inches (46 cm) in diameter. The hoop member 18 may be located as desired but is typically spaced about 9 inches (23 cm) below the intermediate ring 16. The hoops 14 and 16 are typically about two inches (5 cm) apart and the hooks 20 are normally standard size (approximately two-inch, 5 cm) door/window swivel latch hooks, or similar, from which the hook points have been removed or ground off or otherwise blunted to prevent bag punctures. The stakes and hoops are normally jointed as by spot welding, or the like, and form a relatively rigid, stable framework structure. A plurality of these can readily be stacked for storage and they are quite lightweight and portable and can be set up anywhere refuse is to be gathered.

The bag holders may be set up as a temporary trash collector or refuse container anywhere such a device is needed. The sturdy frame structures themselves, independent of the bag, somewhat resemble flower or vegetable support devices and can also be used for this purpose if desired. Also, the frame structures may be made of other materials such as high density polymer material so long as the required physical characteristics are present.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

I claim:

1. A bag holding device for retaining a refuse bag in an open position for fillings comprising:

(a) a pair of spaced bag engaging hoop members including an end hoop member, and an intermediate hoop member spaced from said end hoop member, said end hoop member being adapted to receive the open lip of the bag thereover;

(b) retention means comprising a plurality of snap fit, rigid clamping hook mechanisms pivotally mounted to said intermediate hoop member and disposed to pivot over and resiliently engage said end hoop member such that said end hoop member and said intermediate hoop member are resiliently urged closer together by said hook mechanisms thereby providing a force for said hook mechanism to secure the lip area of the bag peripherally between said hook mechanisms and said end hoop member; and (c) a plurality of peripherally spaced leg members connected to and spacing said end and intermediate hoop members and forming an open framework therewith.

2. The bag holding device of claim 1 wherein both said end hoop member and said intermediate hoop member are of heavy gauge resilient wire.

3. The bag holding device of claim 2 further comprising additional lower hoop member spaced from said intermediate hoop member along said leg members.

4. The bag holding device of claim 2 wherein said clamping hook mechanism comprises a plurality of clamping swivel hooks.

5. The bag holding device of claim 2 wherein said leg members are constructed of heavy gauge wire.

6. The bag holding device of claim 2 wherein each of said clamping hook mechanisms comprises a pair of connected swivel members on either side of one of said leg members.

7. The bag holding device of claim 2 wherein each said plurality of clamping hook mechanisms comprises a pair of spaced swivel members pivotally mounted to said intermediate hoop member and having free ends connected to operate in unison.

8. The bag holding device of claim 7 wherein the connected free ends form a blunt dual hook structure.

9. The bag holding device of claim 8 wherein said swivel members of each said clamping hook mechanisms straddle one of said plurality of leg members.

10. The bag holding device of claim 7 wherein said swivel members of each said clamping hook mechanisms straddle one of said plurality of leg members.

11. The bag holding device of claim 1 further comprising additional lower hoop member spaced from said intermediate hoop member along said leg members.

12. The bag holding device of claim 11 wherein said leg members also have free ends for supporting the bag holder and wherein said leg members converge toward said lower hoop member from said free ends.

13. The bag holding device of claim 12 wherein each said plurality of clamping hook mechanisms comprises a pair of spaced swivel members pivotally mounted to said intermediate hoop member and having free ends connected to operate in unison.

14. The bag holding device of claim 13 wherein the connected free ends form a blunt dual hook structure.

15. A bag holding device for retaining a bag in an open position for filling comprising:

(a) a plurality of leg members;

(b) a plurality of substantially parallel wire hoop members connected to and axially spaced by said plurality of leg members, said hoop members including a relatively closely spaced pair of hoop members comprising outer and inner hoop members connected at one end of said leg members and forming an open framework therewith;

(c) retention means comprising a plurality of pivoting latch mechanisms connected to and spaced along the inner hoop member and disposed to resiliently hook over the outer hoop member for securing bag material of an open bag lip therebetween; and (d) wherein said pair of hoop members connected at one end of said leg members are resilient and temporarily drawn close together where hooking of said plurality of pivoting latch mechanisms occurs.

16. The bag holding device of claim 15 wherein each said plurality of latch mechanisms comprises a pair of spaced swivel members pivotally mounted to said inner hoop member straddling one of said plurality of leg members and having free ends connected to operate in unison.

17. The bag holding device of claim 16 wherein the connected free ends form a blunt elongate hook structure.

* * * * *